US005953754A

United States Patent [19]

Rosch et al.

[11] Patent Number: 5,953,754

[45] Date of Patent: Sep. 21, 1999

[54] CAMISOLE GARMENT

[75] Inventors: Paulette Mary Rosch, Sherwood, Wis.; Ingrid Christine McPhilliamy, Chicago, Ill.; Mark Louis Robinson, Appleton, Wis.

[73] Assignee: Kimberly-Clark Worldwide, Inc., Neenah, Wis.

[21] Appl. No.: 08/841,958

[22] Filed: Apr. 8, 1997

[51] Int. Cl.[6] ..... A41B 9/00

[52] U.S. Cl. ..... 2/73; 2/107; 2/113; 450/92; 450/93

[58] Field of Search ..... 2/1, 46, 48, 49.4, 2/50, 51, 69, 69.5, 70, 71, 72, 75, 80, 83, 90, 93, 94, 97, 104, 105, 106, 109, 110, 111, 113, 73, 115, 122, 129, 211, 243.1, 244; 450/3, 6, 7, 11, 22, 30, 93, 92, 91

[56] References Cited

U.S. PATENT DOCUMENTS

| | | | |
|---|---|---|---|
| 1,382,742 | 6/1921 | Platt . | |
| 2,760,202 | 8/1956 | Ethe . | |
| 2,794,187 | 6/1957 | Edelman | 2/67 |
| 5,371,904 | 12/1994 | McEwen | 2/113 |

FOREIGN PATENT DOCUMENTS

| | | | |
|---|---|---|---|
| 1 925 303 | 12/1970 | Germany | D04B 1/24 |
| 70/3115 | 5/1970 | South Africa . | |
| 486475 | 6/1938 | United Kingdom . | |

*Primary Examiner*—John J. Calvert
*Assistant Examiner*—Katherine Moran
*Attorney, Agent, or Firm*—Patricia A. Charlier

[57] ABSTRACT

A camisole garment including an elastic system which is under tension and a ruffle which forms an edge of the elastic structure whereby the curl-over of the structure is minimized during use.

29 Claims, 3 Drawing Sheets

CAMISOLE GARMENT

BACKGROUND OF THE INVENTION

This invention pertains to elasticized camisole garments particularly, though not exclusively, intended for the use of bathers or swimmers and relates to the kind which are typically disposable and primarily for children.

Currently, disposable waste containment articles find widespread use in the areas of adult care, infant care, and child care, and have generally replaced reusable cloth articles. Disposable diapers, for example, have met a particular need and have become very popular. Disposable training pants have also met a particular need and have become popular. However, once a child desires to travel to a swimming pool or beach, the child requires a waste containment garment for possible "accidents" during such travel as well as during the child's activities at the pool or beach. As part of a disposable swim wear, a disposable girl's top is desired by the child, the parent of that child, or both.

In fitting the child, one form of girl's top is a fully elasticized structure which extends from just about the top of the arm pit to just above the girl's stomach or down to her waist. One problem in the fit of the elasticized material occurs when it has consisted of a bulked web composite such as described in U.S. Pat. No. 4,606,964. The bottom edge of the top has a tendency to curl up and fold over. This creates a poor appearance, and the camisole garment tends to ride up on the wearer.

SUMMARY OF THE INVENTION

Thus, there is a need to provide an improved child's swimming apparel that minimizes the bottom rollover tendency during wearing while maintaining proper coverage. In addition, the top needs to be easy to place on the wearer, durable during wear, and, because the top is disposable, low in cost. In response to these needs, an improved elasticized top has been discovered.

The present invention is for a camisole garment to be worn about the upper body comprising a body-covering assembly having an upper body opening and a lower body opening, each opening having an edge about its perimeter. The body covering assembly comprises a relatively elastic region between the upper edge and the lower edge. The camisole garment includes a lower edge region between the relatively elastic region and the lower edge, wherein the relatively inelastic lower edge region is from about 0.25 to about 4.0 inches in width. The relatively inelastic upper edge region is located between the relatively elastic region and the upper edge wherein the relatively inelastic upper edge region is from about 0.25 to about 4.0 inches in width.

The present invention relates to a camisole garment for wearing about the body. The camisole garment comprises a body covering assembly having an upper body opening and a lower body opening, wherein each opening having an edge about its perimeter. The body covering assembly comprises: a relatively elastic region between the upper edge and the lower edge; a relatively inelastic lower edge region between the relatively elastic region and the lower edge wherein the lower edge region is relatively inelastic compared to the relatively elastic region, and the lower edge region further being from about 0.25 to about 4.0 inches in width; an relatively inelastic upper edge region between the relatively elastic region and the upper edge wherein the upper edge region is relatively inelastic compared to the relatively elastic region, and the upper edge region further being from about 0.25 to about 4.0 inches in width; at least two opposing openings in the relatively elastic region; and, two opposing end portions of the body covering assembly between the upper edge and the lower edge engaged to form a body seam.

Numerous features and advantages of the present invention will appear from the following description. In the description, reference is made to the accompanying drawings which illustrate desired embodiments of the invention. Such embodiments do not represent the full scope of the invention. Reference should therefore be made to the claims herein for interpreting the full scope of the invention.

BRIEF DESCRIPTION OF THE DRAWINGS

The above-mentioned and other features of the present invention and the manner of attaining them will become more apparent, and the invention itself will be better understood by reference to the following description of the invention, taken in conjunction with the accompanying drawings, wherein.

DEFINITIONS

Figure 1:
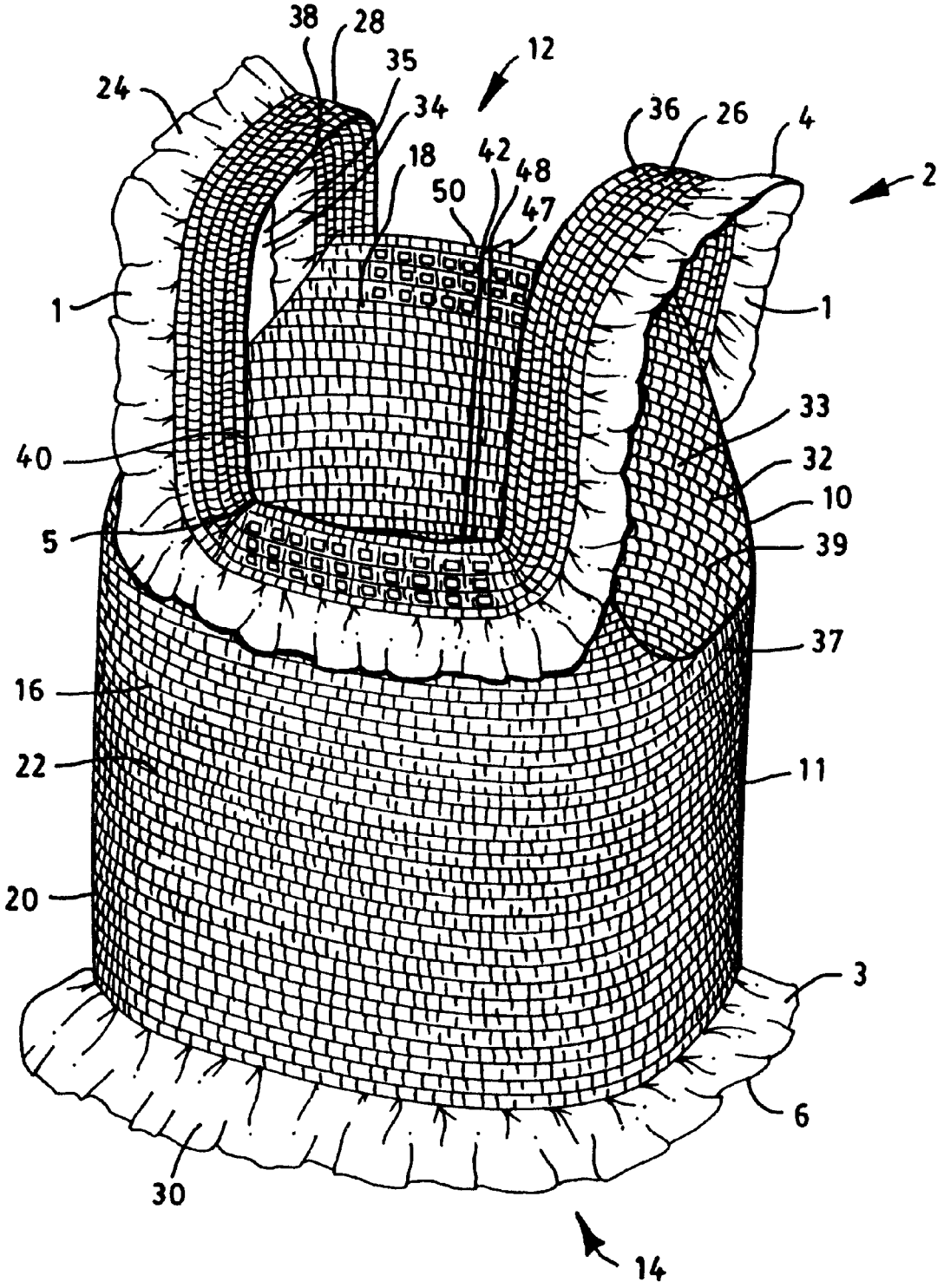
FIG. 1 is a front view of a girl's top typifying an embodiment of the present invention for a camisole garment.

Within the context of this specification, each term or phrase below will include the following meaning or meanings:

(a) "Bonded" refers to the joining, adhering, connecting, attaching, or the like, of two elements. Two elements will be considered to be bonded together when they are bonded directly to one another or indirectly to one another, such as when each is directly bonded to intermediate elements.

(b) "Camisole" refers to a sleeveless top garment, similar to a sleeveless undergarment, but which can be worn as an outer garment.

(c) "Disposable" includes being disposed of after use, and not intended to be washed and reused.

(d) "Disposed", "disposed on", "disposed with", "disposed at", "disposed near", and variations thereof are intended to mean that one element can be integral or unitary with another element, or that one element can be a separate structure joined to or connected to or placed with or placed near another element.

(e) "Elasticity" and "elastic" include that property of a material by virtue of which it tends to substantially recover to its original size and shape after removal of a force causing deformation of the material.

(f) "Elastically connected" and "elastically connecting" refer to two elements being separated by and bonded to an elastic member, where the relative position of the two elements may change due to extension of the elastic member.

(g) "Elongation" includes the ratio of the extension of a material to the length of a material prior to the extension. Elongation is expressed in percent.

(h) "Extension", "extend", and "extended" include the change in length of a material due to stretching. Extension is expressed in units of length.

(i) "Force" includes a physical influence exerted by one body on another which produces acceleration of bodies that are free to move and deformation of bodies that are not free to move. Force is expressed in grams-force.

(j) "Foreshortened" and "foreshortening" include to shorten beforehand, that is, before a subsequent step.

(k) "Front" and "back" are used to designate relationships relative to the garment itself, rather than to suggest any position the garment assumes when it is positioned on a wearer.

(l) "Gatherable" material is one which, when bonded to the reticular web with the latter under tension, will gather, with the formation of puckers or gathers, to accommodate contraction of the reticulated web upon release of the tensioning forces.

(m) "Member" when used in the singular can have the dual meaning of a single element or a plurality of elements.

(n) "Operatively joined" with reference to the attachment of an elastic member to another element means that the elastic member when attached to or connected to or treated with heat with the element gives that element elastic properties. With reference to the attachment of a non-elastic member to another element, it means that the member and element can be attached in any suitable manner that permits or allows them to perform the intended or described function of the joinder. The joining, attaching, connecting or the like can be either directly, such as joining either member directly to an element, or can be indirectly by means of another member or element disposed between the first member and the first element.

(o) "Ruffles" includes the region of the material which lies outside the outermost elastic and includes no elastic material. That is, no elastic material is present or the elastic material which was present has been rendered inelastic.

(p) "Rupture" includes the breaking or tearing apart of a material. In tensile testing, rupture refers to the total separation of a material into two parts, either all at once or in stages, or the development of a hole in some materials.

(q) "Stretch bonded" refers to an elastomeric strand being bonded to another member while the elastomeric strand is elongated at least about 25 percent of its relaxed length. Desirably, the term "stretch bonded" refers to the situation wherein the elastomeric strand is elongated at least about 50 percent, more desirably at least about 300 percent, of its relaxed length when it is bonded to the other member.

(r) "Stretch bonded laminate" ("SBL") refers to a composite material having at least two layers in which one layer is a gatherable layer and the other layer is a stretchable, that is, elastic, layer. The layers are joined together when the stretchable layer is in a stretched condition so that upon relaxing the layers, the gatherable layer is gathered.

(s) "Tension" includes a uni-axial force tending to cause the extension of a body or the balancing force within that body resisting the extension.

(t) "Two-dimensional" refers to a garment, such as a diaper, that can be opened and laid in a flat condition without destructively tearing any structure. This type of garment does not have continuous leg and waist openings when opened and laid flat, and requires a fastening device, such as adhesive tapes, to attach the garment about the wearer.

(u) "Three-dimensional" refers to a finished garment similar to shorts or pants in that they have continuous leg and waist openings that are bounded by the material of which the garment is made. This type of garment can be opened and laid flat only by destructively tearing it. This type of garment may or may not have manually tearable seams.

(v) "Ultimate elongation" includes the elongation at the point of rupture.

These definitions are not intended to be limiting and these terms may be defined with additional language in the remaining portion of the specification.

DETAILED DESCRIPTION

Referring to FIG. 1, one embodiment of the present invention is a camisole garment 2 for wearing about the body comprising an elastic top 10 having a body covering assembly 11, an upper body opening 12 and a lower body opening 14, each opening 12 and 14 having an edge 4 or 6, respectively, about its perimeter. The top 10 comprises an outer cover 16 and bodyside liner 18 both of which generally cover a series of body elastics 20.

The body elastics 20 circumferentially surround the body of the wearer to form a relatively elastic region 22 of the top 10. The body elastics 20 act independently to conform to the contours of various body types and builds. This provides a smooth, conformable, and comfortable fit within a given chest size range.

About the lower body opening 14, below and adjacent the relatively elastic region 22, there is formed at the lower edge 6 a relatively inelastic lower edge region 30. In addition, about the upper body opening 12, above and adjacent the relatively elastic region 22, there is formed at the upper edge 4 a relatively inelastic upper edge region 24. The relatively inelastic upper edge region 24 and the relatively inelastic lower edge region 30 form areas of ruffles on the top 10. The relatively inelastic upper edge region 24 and the relatively inelastic lower edge region 30 each have a width ranging from about 0.25 to about 4.0 inches. The widths of these regions 24 and 30 are independent of each other. The desired width of the relatively inelastic upper edge region 24 and the relatively inelastic lower edge region 30 is between about 0.25 to about 2.0 inches, and more desirably, from about 0.25 to about 1.0 inch.

A pair of openings 32 and 34, serving as arm holes 33 and 35, respectively, are cut out of the relatively elastic region 22, desirably adjacent or near the inelastic upper region 24. The top edges 36 and 38 of the openings 32 and 34, respectively, may be located from about 0.25 inch to about 2.0 inches below the relatively inelastic upper edge region 24. The openings 32 and 34 are desirably located in opposing positions. The openings 32 and 34 may be slits, circular holes, square holes, oval holes, irregular shaped holes, or the like.

In a top 10 intended for a 25 pound girl, the body elastics 20 are about 16 inches (406 mm) long unstretched. For a top 10 that does not cover the girl's stomach, the height of the top 10 is about 5.75 inches (146 mm) wide. For a top 10 that does cover to the waist the height may be about 9.50 inches (229 mm) wide. If it does extend to the waist, the top 10 may be fastened to a bottom or pant-type garment.

The top 10 includes a pair of straps 26 and 28 which help hold the camisole garment 2 in place. The straps 26 and 28 are formed by the material located above the top edges 36 and 38 of the arm holes 32 and 34. The straps 26 and 28 may be formed by folding the upper edge 4, the relatively inelastic upper edge region 24, and a portion of the relatively elastic region 22 back onto relatively elastic region 22 of the top 10. Desirably, the outer cover 16 is folded back onto itself, exposing a portion of the bodyside liner 18 and creating a neckline edge fold 40. In an alternative embodiment, the bodyside liner 18 is folded back onto itself, positioning a portion of the outer cover 16 against the body of the wearer.

Figure 2:
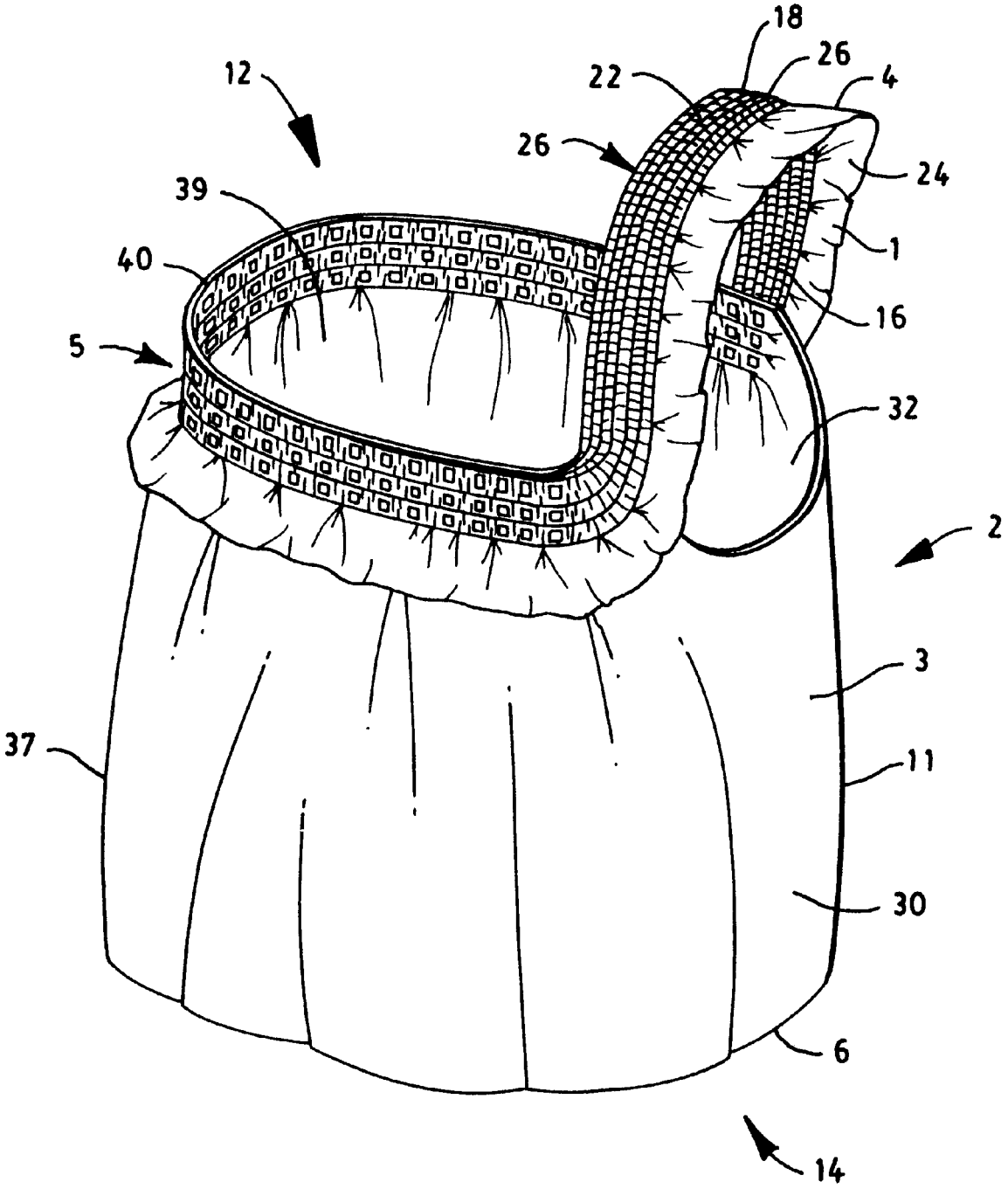
FIG. 2 is a front view of a top typifying another embodiment of the present invention for a camisole garment having one shoulder strap.

In an alternative embodiment of the present invention (See FIG. 2), the body covering assembly 11 includes only one opening 32 in the relatively elastic region 22 of the body covering assembly 11, and adjacent to the relatively inelastic upper edge region 24 of the fabric 3. Desirably, the outer cover 16 is folded back onto itself, exposing a portion of the bodyside liner 18 and creating a neckline edge fold 40. In an alternative embodiment, the bodyside liner 18 is folded back onto itself, positioning a portion of the outer cover 16 against the body of the wearer. Only one shoulder strap 26 is formed on the camisole garment 2.

In a desired embodiment, the folded material 5 which includes the upper edge 4 and the portion of the body covering assembly 11 lies on the outer surface 37 of the finished garment 2. In another embodiment, the folded material 5 lies on the inner surface 39 of the finished garment 2.

The neckline edge fold 40 is maintained by bonding the folded portion to the top 10 thereby forming a non-refastenable seam. The non-refastenable seam 42 may be formed by any suitable means such as ultrasonic sealing, adhesive bonding, heat sealing, or the like. One suitable method of forming such seams is disclosed in U.S. Pat. No. 4,938,753 issued Jul. 3, 1990, to Van Gompel et al., which is incorporated herein by reference.

Both the outer cover 16 and the bodyside liner 18 are desirably compliant and soft feeling to the wearer. The following description of materials from which the outer cover 16 may be formed may also be used to form the material of the bodyside liner 18.

The outer cover 16 may be any suitable gatherable material, such as a woven material, a nonwoven material, a fibrous or a polymeric film material and may be, although they need not necessarily be, an elastic material. Suitable fibrous gatherable webs may utilize any suitable natural and/or synthetic fibers, for example, woven or nonwoven webs of fibers made of acrylic polymers, polyester, polyamide, glass, polyolefins, e.g., polyethylene and polypropylene, cellulosic derivatives such as rayon, cotton, silk, wool, pulp, paper and the like, as well as blends or combinations of any two or more of the foregoing. The gatherable webs may also comprise polymeric film layers such as polyethylene, polypropylene, polyamide, polyester, acrylic polymers, and compatible mixtures, blends and copolymers thereof.

The outer cover 16 may be liquid pervious, permitting liquids to readily penetrate into its thickness, or impervious, resistant to the penetration of liquids into its thickness. Outer cover 16 may be made from a wide range of materials, such as natural fibers (e.g. wood or cotton fibers), synthetic fibers (e.g. polyester or polypropylene fibers) or from a combination of natural and synthetic fibers or reticulated foams and apertured plastic films. The outer cover 16 may be woven, nonwoven or film such as spunbonded, carded, or the like. A suitable outer cover 16 is carded, and thermally bonded by means well known to those skilled in the fabric art. Alternatively, the outer cover 16 is derived from a spunbonded web. In a desired embodiment, the outer cover 16 is spunbonded polypropylene nonwoven, meltblown polypropylene nonwoven and spunbonded polypropylene nonwoven laminate (SMS). The basis weight per ply of SMS is about 0.4 to about 1.0 osy (more desirably 0.6 osy) and is made with about 86% spunbonded nonwoven and 14% meltblown nonwoven. A pigment such as titanium dioxide may be incorporated into the outer cover 16 and bodyside liner 18. A variety of pigment colorants may also be added. Such spunbonded meltblown nonwoven laminate material is available from Kimberly-Clark Corporation, Roswell, Ga. The basis weight of the SMS material may vary from about 0.4 to about 1.0 osy.

In other desired embodiments, the outer cover 16 is spunbonded polypropylene nonwoven with a wireweave bond pattern having a grab tensile of 19 pounds as measured by ASTM D1682 and D1776, a Taber 40 cycle abrasion rating of 3.0 as measured by ASTM D1175 and Handle-O-Meter MD value of 6.6 grams and CD value of 4.4 grams using TAPPI method T402. Such spunbonded material is available from Kimberly-Clark Corporation, Roswell, Ga. The outer cover 16 has a weight of from about 0.5 oz. per square yard (osy) to about 1.5 osy, desirably about 0.7 osy.

The outer cover 16 may be constructed of a single spunbonded polypropylene nonwoven web having a basis weight of about 0.5 oz/yd$^2$ (17 gsm) to about 1.5 oz/yd$^2$ (51 gsm). In the structure of the top 10, the outer cover 16 desirably comprises a material having a basis weight of from about 0.5 oz/yd$^2$ (17 gsm) to about 1.5 oz/yd$^2$ (51 gsm). Lesser basis weights may be used in the other regions of the article. Since the camisole garment 2 is typically intended for active wear, the outer cover 16 or portions thereof, can be made of materials having a basis weight and bonded structure which resist abrasion.

The bodyside liner 18 may be any soft, flexible, porous sheet. Again, the bodyside liner 18 must permit submersion in fresh water or salt water or treated water (chlorinated or bromated) and still retain its integrity.

The bodyside liner 18 may comprise, for example, a nonwoven web or sheet of a spunbonded, meltblown or bonded-carded web composed of synthetic polymer filaments, such as polypropylene, polyethylene, polyesters or the like, or a web of natural polymer filaments such as rayon or cotton. The bodyside liner 18 may be selectively embossed or perforated with discrete slits or holes extending therethrough.

A suitable adhesives for adhering the laminate layers is H2096 hot melt adhesive can be obtained from Findley Adhesives, Inc. of Wauwatosa, Wisc.

The outer cover 16 and bodyside liner 18 may be further dyed, pigmented, or imprinted with any suitable color or pattern. Desirably, the bodyside liner 18 is either dyed, pigment, or printed with a material which does not irritate or bleed the color onto the skin of the wearer.

Materials suitable for use as the body elastics 20 include a wide variety, but not limited to, elastic threads, meltblown elastomeric polymer, yarn rubber, flat rubber (e.g. as bands), elastic tape, film-type rubber, polyurethane, and tape-like elastomer, or foam polyurethane or formed elastic scrim. Each body elastic 20 may be unitary, multi-part, or composite in construction. Threads or ribbons, where used, may be multiple and may be applied as a composite. The elastomerics used in the body elastics 20 may be latent and non-latent.

Desirably, the body elastics 20 are elongated to between about 50% to about 300%. The elongations may vary for separate elements and still be within the overall elongation for the composite of the elements comprising the body elastics 20.

As illustrated most clearly in FIG. 1, opposing end portions 48 and 50 of top 10 may be bonded together in the finished top 10 to form a body seam 46 that is non-refastenable. The non-refastenable body seam 46 may be formed by any suitable means such as ultrasonic sealing, adhesive bonding, heat sealing, or the like, as discussed above. In other embodiments, the opposing end portions 48 and 50 of the top 10 may be held together in the finished top 10 to form a refastenable body seam 46.

Refastenable means for securing the opposing end portions 48 and 50 of the top 10 include adhesives and mechanical type fasteners 96. Mechanical type fasteners include buttons, button holes, snaps, buckles, clasps, hooks and loops, end extensions, tabs, and the like which are designed or adapted to interlock or engage some type of a complimentary device or the outer cover 16 of the top 10. In addition, elasticized fasteners may also be used in assuring better fit of the camisole garment 2.

The structure material of the top 10 desirably has stretch characteristics in a first direction such that it is capable of from about 10 to about 500 percent elongation and upon release of tension will recover at least 55 percent of its elongation. It is generally desired that the structure material of the top 10 in the first direction be capable of between about 50 and about 300 percent elongation, particularly at least 125 percent elongation and recovery upon release of tension of at least 80 percent of its elongation.

As described previously, the top 10 may be formed of a material capable of stretching in one direction or capable of stretching in at least two substantially perpendicular directions. One suitable one-directional stretch material is disclosed in U.S. Pat. No. 4,720,415 issued Jan. 19, 1988, to Vander Wielen et al., which is incorporated herein by reference.

The one-directional stretch material may comprise a composite material including at least one gatherable web bonded to at least one elongated elastic web. The elastic web may be an elastic film or nonwoven fibrous elastic webs such as meltblown elastomeric fibrous webs. In one embodiment, the top 10 comprises a stretch bonded laminate formed of a pre-stretched elastic meltblown inner layer sandwiched between and attached to a pair of spunbond polypropylene nonwoven webs, each web having a basis weight of about 0.4 oz/yd$^2$ (13.6 gsm). Suitable elastic materials can be purchased from the Shell Chemical Company of Houston, Tex. under the trade name Kraton. Other suitable one-directional stretch materials are disclosed in U.S. Pat. Nos. 4,606,964 issued Aug. 19, 1986, to Wideman and 4,657,802 issued Apr. 14, 1987, to Morman.

Suitable two-directional stretch materials for the body elastics 20 are disclosed in U.S. Pat. Nos. 5,114,781 issued May 19, 1992, and 5,116,662 issued May 26, 1992, to Morman, which are incorporated herein by reference. A two-directional stretch material may comprise a composite material including a neckable material and an elastic sheet, which may be formed by meltblowing or extrusion. Neckable materials are those which may be constricted in at least one dimension by applying a tensioning force in a direction perpendicular to the desired direction of neck-down, and may include a spunbonded, meltblown or bonded carded web. The tensioned, necked neckable material may be joined to the elongated elastic sheet at spaced locations arranged in a nonlinear configuration.

Another two-directional stretch composite material may comprise one or more layers of reversibly necked material joined to one or more layers of elastic sheet at spaced locations. Reversibly necked materials are those that have been treated, such as with heat, while necked to impart memory to the material so that, when a force is applied to extend the material to its pre-necked dimensions, the treated, necked portions will generally recover to their necked dimensions upon termination of the force.

Desirably, the material stretches in horizontal direction only, that is, around the body. If the material is elastic in both directions, it is desirable to limit the stretch in the vertical direction to less than about 20% under normal tensions.

Alternately, the body elastics 20 may be formed of a dry-spun coalesced multi-filament elastomeric thread sold under the tradename LYCRA and available from I.E. Du Pont de Nemours and Company. Still alternately, the elastics may be formed of other typical elastics utilized in the diaper-making art, such as a thin ribbon of elastic material as disclosed in U.S. Pat. No. 4,940,464 issued Jul. 10, 1990, to Van Gompel et al., which is incorporated herein by reference. Elasticity could also be imparted to the structure material of the top 10 by extruding a hot melt elastomeric adhesive between the outer cover 16 and the bodyside liner 18. Other suitable elastic gathering means are disclosed in U.S. Pat. Nos. 4,938,754 to Mesek and 4,388,075 to Mesek et al.

In forming the top 10 structure material, the body elastics 20 may be individually laid on one of the adjacent gatherable layers (outer cover 16 or bodyside liner 18) and the other gatherable layer web applied over the elastics to bond the first layer. Alternatively, only one gatherable layer, e.g., the outer cover 16, may be employed and the body elastics 20 bonded to one side, desirably the bodyside, of the outer cover 16. In such an embodiment, the body elastics 20 are left exposed on one side of the outer cover 16.

Figure 3:
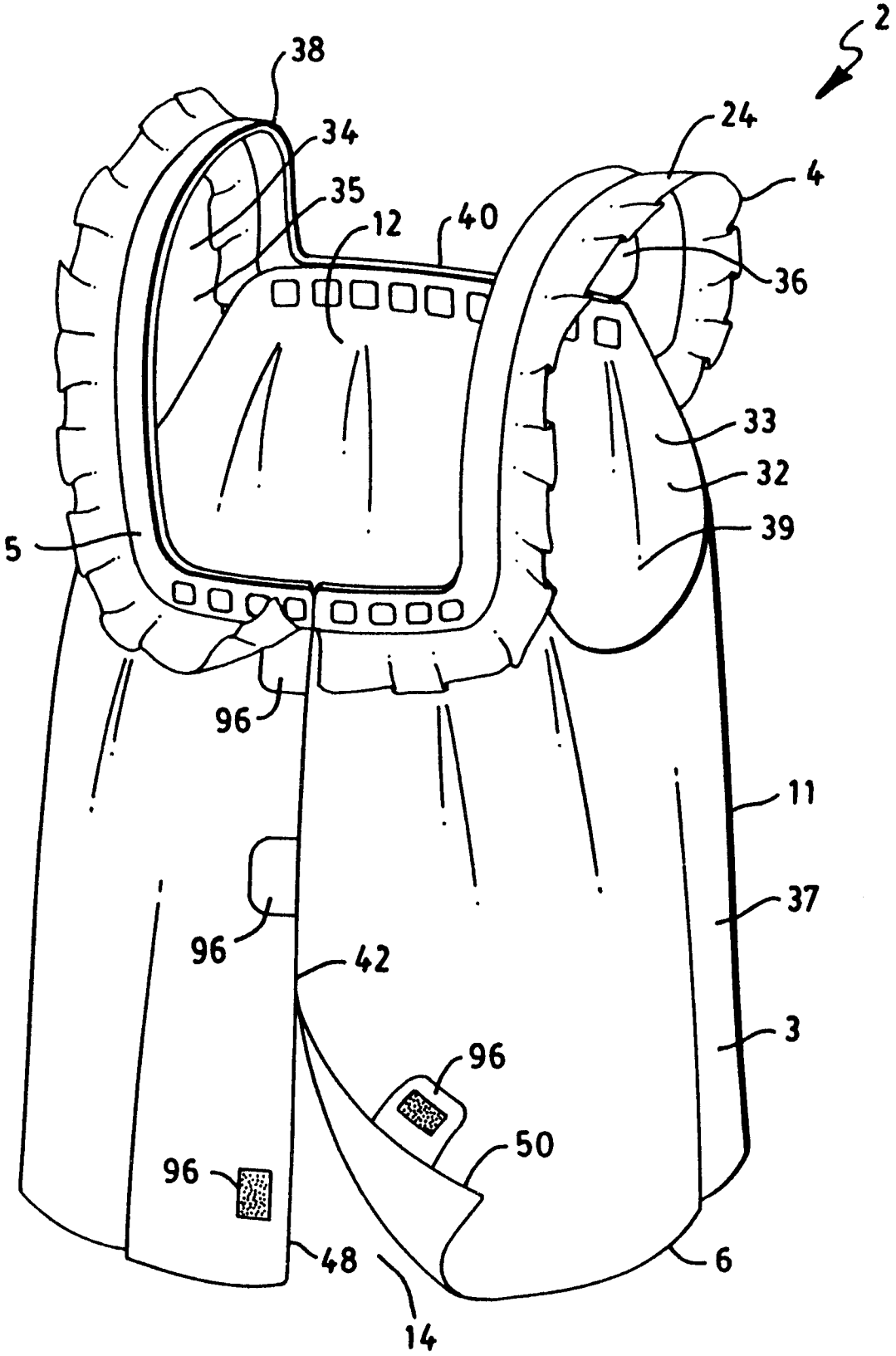
FIG. 3 is a back view of a top typifying an embodiment of the present invention showing a refastenable body seam.

Another embodiment of the present invention is a camisole garment 2 for wearing about the body comprising a body covering assembly 11 having an upper body opening 12 and a lower body opening 14. (See FIG. 3) The upper body opening 12 has an upper edge 4 about its perimeter. The lower body opening 14 has a lower edge 6 about its perimeter.

The body covering assembly 11 comprises a single layer web of fabric 3 between the upper edge 4 and the lower edge 6 of the fabric 3; at least two opposing openings 32 and 34 in the body covering assembly 11; two opposing end portions 48 and 50 between the upper edge 4 and the lower edge 6 of the fabric 3; and, a neckline edge fold 40 created by folding the upper edge 4 and a portion of the body covering assembly 11 above the opposing openings 32 and 34 over onto the body covering assembly 11. In the desired embodiment, the folded material 5 which includes the upper edge 4 and the portion of the body covering assembly 11 lies on the outer surface 37 of the finished garment 2. In another embodiment, the folded material 5 lies on the inner surface 39 of the finished garment 2.

The single layer web of fabric 3 used in the process may be any suitable material, such as a woven material, a nonwoven material, a fibrous or a polymeric film material and may include an elastic material. Suitable fibrous webs may utilize any suitable natural and/or synthetic fibers, for example, woven or nonwoven webs of fibers made of acrylic polymers, polyester, polyamide, glass, polyolefins, e.g., polyethylene and polypropylene, cellulosic derivatives such as rayon, cotton, silk, wool, pulp, paper and the like, as well as blends or combinations of any two or more of the foregoing. The web may also comprise a polymeric film layer such as polyethylene, polypropylene, polyamide, polyester, acrylic polymers, and compatible mixtures, blends and copolymers thereof.

The fabric 3 may be liquid pervious, permitting liquids to readily penetrate into its thickness, or impervious, resistant to the penetration of liquids into its thickness. The fabric 3 may also be made from a wide range of materials, such as natural fibers (e.g. rayon, wood, or cotton fibers), synthetic fibers (e.g. polyester or polypropylene fibers) or from a combination of natural and synthetic fibers or reticulated foams and apertured plastic films. The fabric 3 may be woven, nonwoven or film such as spunbonded, meltblown, bond-carded, or the like. A suitable fabric 3 is carded, and thermally bonded by means well known to those skilled in the fabric art.

The fabric 3 may be further dyed, pigmented, or imprinted with any suitable color. Desirably, the fabric 3 is either dyed, pigmented, or printed with a material which does not irritate or bleed the color onto the skin of the wearer.

The body seam 42 of the camisole garment 2 may comprise a non-refastenable body seam 42 by engaging the two opposing end portions 48 and 50 (See FIG. 1). The non-refastenable body seam 46 may be formed by any suitable means such as ultrasonic sealing, adhesive bonding, heat sealing, or the like, as discussed above. In other embodiments, the opposing end portions 48 and 50 of the top 10 may be held together in the finished top 10 to form a refastenable body seam 42. (See FIG. 3)

In another embodiment of the present invention, the body seam 42 of the camisole garment 2 comprises a refastenable body seam 42 by refastenably engaging the two opposing end portions 48 and 50. Refastenable means for securing the opposing end portions 48 and 50 of the top 10 include adhesives and mechanical type fasteners 96. Mechanical type fasteners include buttons, button holes, snaps, buckles, clasps, hooks and loops, end extensions, tabs, and the like which are designed or adapted to interlock or engage some type of a complimentary device or the outer cover 16 of the top 10. In addition, elasticized fasteners may also be used in assuring better fit of the camisole garment 2.

In another embodiment of the present invention, the camisole garment 2 for wearing about the body comprises a body covering assembly 11 having an upper body opening 12 and a lower body opening 14. (See FIG. 2) The upper opening 12 has an upper edge 4 about its perimeter. The lower opening 14 has a lower edge 6 about its perimeter.

The body covering assembly 11 comprises a single layer web of fabric 3 between the upper edge 4 and the lower edge 6; at least one opening 32 in the body covering assembly 11 adjacent to the upper edge 4 of the fabric 3; two opposing end portions 48 and 50 (not shown) between the upper edge 4 and the lower edge 6; and, a neckline edge fold 40 created by folding the upper edge 4 and a portion of the body covering assembly 11 above the opening 32 over onto the body covering assembly 11.

In the desired embodiment, the folded material 5 which includes the upper edge 4 and the portion of the body covering assembly 11 lies on the outer surface 37 of the finished garment 2. In another embodiment, the folded material 5 lies on the inner surface 39 of the finished garment 2.

The camisole garment 2 may further comprise a non-refastenable body seam 42 by non-refastenably engaging the two opposing end portions 48 and 50. The non-refastenable body seam 42 may be formed by any suitable means such as ultrasonic sealing, adhesive bonding, heat sealing, or the like, as discussed above. In other embodiments, the opposing end portions 48 and 50 of the top 10 may be held together in the finished top 10 to form a refastenable body seam 42.

In another embodiment of the present invention, the body seam 42 of the camisole garment 2 comprises a refastenable body seam 42 by refastenably engaging the two opposing end portions 48 and 50. Refastenable means for securing the opposing end portions 48 and 50 of the top 10 include adhesives and mechanical type fasteners 96. Mechanical type fasteners include buttons, button holes, snaps, buckles, clasps, hooks and loops, end extensions, tabs, and the like which are designed or adapted to interlock or engage some type of a complimentary device or the outer cover 16 of the top 10. In addition, elasticized fasteners may also be used in assuring better fit of the camisole garment 2.

The present invention relates to a camisole garment 10 for wearing about the body comprising a body covering assembly 11 having an upper body opening 12 and a lower body opening 14, wherein each opening having an edge about its perimeter. The body covering assembly 11 comprises: a relatively elastic region 22 between the upper edge 4 and the lower edge 6; a relatively inelastic lower edge region 30 between the relatively elastic region 22 and the lower edge 6 wherein the lower edge region 30 is relatively inelastic compared to the relatively elastic region 22, and the lower edge region 30 further being from about 0.25 to about 4.0 inches in width; an relatively inelastic upper edge region 24 between the relatively elastic region 22 and the upper edge 4 wherein the upper edge region 24 is relatively inelastic compared to the relatively elastic region 22, and the upper edge region 24 further being from about 0.25 to about 4.0 inches in width; at least two opposing openings 32 and 34 in the relatively elastic region 22; and, two opposing end portions 48 and 50 of the body covering assembly 11 between the upper edge 4 and the lower edge 6 engaged to form a body seam 42.

The camisole garment 10 may further comprise a neckline edge fold 40 created by folding over the upper edge 4, the relatively inelastic upper edge region 24 and a portion of the relatively elastic region 22 above the opposing openings 32 and 34. The camisole garment 10 may comprise an outer cover 16 and a bodyside liner 18, both of which cover a series of body elastics 20 which circumferentially surround the body to form the relatively elastic region 22.

In the present invention, the two opposing end portions 48 and 50 of the garment 10 may be refastenably engaged to form a refastenable body seam 42. In the alternative, the two opposing end portions 48 and 50 of the garment 10 may be non-refastenably engaged to form a non-refastenable body seam 42.

The outer cover 16 of the camisole garment 10 may be a gatherable material; a woven material; a nonwoven material; a polymeric film material; a fibrous material; or, an elastic material. The outer cover 16 may be a spunbonded polypropylene nonwoven material, meltblown polypropylene nonwoven material, or spunbonded polypropylene nonwoven material laminate.

The outer cover 16 may be comprised of acrylic polymer, polyester, polyamide, glass, polyethylene, polypropylene, rayon, cotton, silk, wool, pulp, paper, or a blend or combination of two or more of the foregoing. Alternatively, the outer cover 16 may comprise acrylic polymer, polyester, polyamide, polyethylene, polypropylene, or a compatible mixture, blend or copolymer thereof. The outer cover 16 may have a basis weight of from about 0.4 to about 1.0 ounces per square yard, and contain about 86% spunbonded polypropylene nonwoven material and about 14% meltblown polypropylene nonwoven material.

The bodyside liner 18 of the camisole garment 10 may be a soft, flexible porous sheet which permits submersion in fresh water, salt water, chlorinated water or brominated water and thereafter retains its integrity. The body liner 18 may comprise a nonwoven or sheet of spunbonded, meltblown or bonded-carded web composed of polypropylene, polyethylene, polyester, rayon, or cotton filaments.

The body elastics 20 are elastic threads, yarn rubber, flat rubber, elastic tape, polyurethane, or foamed elastic scrim. The body elastics 20 are elongated to between about 50% to about 300%.

The body covering assembly 11 of the camisole garment 10 may be made of materials having stretch characteristics such that the body covering assembly is capable of between about 50% to about 300% elongation, and recovery, upon release of tension, of at least 80% of its elongation. The body covering assembly 11 may be made of materials capable of stretching in one direction or of materials capable of stretching in two substantially perpendicular directions.

Another embodiment of the present invention is a camisole garment 10 for wearing about the body comprising a body covering assembly 11 having an upper body opening 12 and a lower body opening 14, wherein each opening having an edge about its perimeter. The body covering assembly 11 comprises: a single layer web of fabric 3 between the upper edge 4 and the lower edge 6; at least two opposing openings 32 and 34 in the body covering assembly 11; two opposing end portions 48 and 50 between the upper edge 4 and the lower edge 6; and, a neckline edge fold 40 created by folding the upper edge 4 and a portion of the body covering assembly 11 above the opposing openings 32 and 34.

The camisole garment 10 further comprises a non-refastenable body seam 42 by engaging the two opposing end portions 48 and 50. In the alternative, the garment 10 may comprising a refastenable body seam 42 by refastenably engaging the two opposing end portions 48 and 50.

In still another embodiment, the present invention relates to a camisole garment 10 for wearing about the body comprising a body covering assembly 11 having an upper body opening 12 and a lower body opening 14, wherein each opening having an edge about its perimeter. The body covering assembly 11 comprises: a single layer web of fabric 3 between the upper edge 4 and the lower edge 6; at least one opening 32 in the body covering assembly 11 adjacent to the upper edge 4 of the fabric 3; two opposing end portions 48 and 50 between the upper edge 4 and the lower edge 6; and, a neckline edge fold 40 created by folding the upper edge 4 and a portion of the body covering assembly 11 above the opening 32.

The camisole garment 10 may further comprise a non-refastenable body seam 42 by engaging the two opposing end portions 48 and 50. Alternatively, the camisole garment 10 may further comprise a refastenable body seam 42 by refastenably engaging the two opposing end portions 48 and 50.

According to another embodiment of the present invention, the camisole garment 10 for wearing about the body comprising a body covering assembly 11 having an upper body opening 12 and a lower body opening 14, wherein each opening having an edge about its perimeter. The body covering assembly 11 comprises: a relatively elastic region 22 between the upper edge 4 and the lower edge 6; a relatively inelastic lower edge region 30 between the relatively elastic region 22 and the lower edge 6 wherein the lower edge region 30 is relatively inelastic compared to the relatively elastic region 22, and the lower edge region 30 further being from about 0.25 to about 4.0 inches in width; an relatively inelastic upper edge region 24 between the relatively elastic region 22 and the upper edge 4 wherein the upper edge region 24 is relatively inelastic compared to the relatively elastic region 22, and the upper edge region 24 further being from about 0.25 to about 4.0 inches in width; at least one opening 32 in the relatively elastic region 22; and, two opposing end portions 48 and 50 of the body covering assembly 11 between the upper edge 4 and the lower edge 6 engaged to form a body seam 42.

The camisole garment 10 may further comprise a neckline edge fold 40 created by folding over the upper edge 4, the relatively inelastic upper edge region 24 and a portion of the relatively elastic region 22 above the opening 32. The camisole garment 10 may also comprise an outer cover 16 and a bodyside liner 18, both of which cover a series of body elastics 20 which circumferentially surround the body to form the relatively elastic region 11.

The two opposing end portions 48 and 50 may be refastenably engaged to form a refastenable body seam 42. Alternatively, the two opposing end portions 48 and 50 are non-refastenably engaged to form a non-refastenable body seam 42.

Although the camisole garment 2 of this invention is generally intended to be disposable, any camisole garment which is reusable may take advantage of this invention. Thus, both reusable and disposable items (the latter term meaning items intended to be discarded after a single use rather than being laundered and reused) are provided by the present invention.

The foregoing detailed description has been for the purpose of illustration. Thus, a number of modifications and changes may be made without departing from the spirit and scope of the present invention. For instance, alternative or optional features described as part of one embodiment can be used to yield another embodiment. Therefore, the invention should not be limited by the specific embodiments described, but only by the claims.

EXAMPLE

The material used to obtain this example consists of a laminate made of 2 facings of 0.6 osy nonwoven material covering 470 decitex LYCRA elastic strands placed at about 7 strands per inch width of material. The elastic strands are adhesively attached using an add-on of 5 gsm. The elastics are also applied at 150% to 170% stretch. The width of the final laminate is 4 inches, excluding any non-elasticized ruffle that is added.

The ruffle is formed on the edge of the material by eliminating the elastic strands and allowing the 2 nonwoven facings to be bonded adhesively together, then slitting to the desired ruffle width. The nonwoven used in this case was a 0.6 osy spunbond/meltblown/spunbond laminate (SMS), although other nonwoven facings (i.e. 0.4 and 0.6 osy spunbond) have shown similar results. In addition, the elastic strands decitex and spacing, the adhesive add-on and the percent stretch may also vary. The codes tested are as follows:

Code A: 4.0" SMS/elastic strand laminate with no ruffle

Code B: 4.0" SMS/elastic strand laminate with 0.25" ruffle

Code C: 4.0" SMS/elastic strand laminate with 0.50" ruffle

Code D: 4.0" SMS/elastic strand laminate with 0.75" ruffle

Code E: 4.0" SMS/elastic strand laminate with 1.0" ruffle (desired design)

Code F: 5.25" SMS/elastic strand laminate with no ruffle (this code was tested to eliminate the effect of sample width on the data).

Samples of each code are cut to at least 18" in length (this provides for a testing length of 16", the approximate length needed to make a swimsuit top) and an inch on either side for attachment to the test template. The center of the width of each sample is determined as between the two outermost strands of elastics strands and a line is drawn down the entire center length of the sample. The ruffle width is not included in the measurement.

A piece of foam core or cork board is marked at 0", 16", 20" and 21.5". The 20" and 21.5" marks represent the 16" sample pulled to 25% and 35% respectively, which is the typical amount of stretch the material demonstrates when worn by a typical child.

Using a pin, one end of the material is attached into the board at the 0" mark. Taking care to lay the material flat and straight, but without any elongation, the pin through the second end of the material is attached into the board at the 16" mark once the material is attached, the end of the material at the 16" mark is stretched to 20" by removing the pin from the board and using the pin to pull the material to the 20" mark. Any wrinkles are smoothed out around the pin and the sample is allowed to sit for 5 minutes.

After waiting for 5 minutes, the amount of curling of the lengthwise edges of the material is measured. This is accomplished with an inverted U-shaped clear template (approximately 2.0" high by 6.0" wide and 6.0" with a line drawn lengthwise at the centerline of the template. When placed over the sample, the centerline of the template should be directly over the centerline of the sample. In addition, the edge of the template (start of the centerline) should be placed at the exact center of the length of the sample (a line drawn of the board prior to testing to mark this point).

Measurement of amount of curl is accomplished by placing the U-shaped template over the sample so that the centerline of the template is directly above the centerline of the sample. Once the template is in place, measure the distance (in mm) from the centerline to each edge of the material should be measured and recorded. If the material has curled over enough to cover the centerline of the sample, the distance past the centerline should be added as well. In addition, it should be noted whether the material edge has just curled or has actually begun to fold over. After recording the measurements, the results for the ruffled material should be adjusted to take into account the width of the ruffle. This is accomplished by subtracting the width of the ruffle from the respective results of materials with ruffles.

After the measurements are completed at 25% stretch, the material pulled to the 21.5 inch mark (35% elongation) using the pin again. The measurements of curl-over should be taken as described above and recorded. The results of such testing are shown in the Table below and illustrated in FIGS. 3–6.

The test results are shown Table 1. From the test results, FIG. 3 was prepared showing curl over for the material with no ruffles and 25% stretch. FIG. 4 shows curl over for no ruffle and 35% stretch. FIG. 5 is a chart showing curl over for ruffles of 0.25, 0.5, 0.75 and 1.00 inch at 25% stretch. FIG. 6 is a chart showing curl over for ruffles of 0.25, 0.50, 0.75 and 1.0 inch at 35% stretch. Improvement (the reduced edge curl-over) is shown for each width of ruffle in comparison to the materials lacking a ruffle.

| | | | | DISTANCE FROM EDGE ELASTOMERIC STRAND TO LAMINATE CENTERLINE (mm) | | | | | |
|---|---|---|---|---|---|---|---|---|---|
| | Ruffle Width | | Percent | SAMPLE NUMBER | | | | | Mean Distance |
| Sample | (in) | Side | Stretch | 1 | 2 | 3 | 4 | 5 | (mm) |
| 1 | 0.00 | A | 25 | 40.00 | 35.00 | 38.00 | 46.00 | 37.00 | 39.2 |
| 1 | 0.00 | Aa | 25 | 20.00 | 23.00 | 30.00 | 18.00 | 33.00 | 24.8 |
| 1 | 0.00 | A | 35 | 31.00 | 24.00 | 30.00 | 41.00 | 30.00 | 31.2 |
| 1 | 0.00 | Aa | 35 | 2.00 | 6.00 | 19.00 | 2.00 | 22.00 | 10.2 |
| 2 | 0.25 | A | 25 | 40.00 | 48.00 | 48.00 | 49.00 | 52.00 | 47.4 |
| 2 | 0.25 | B | 25 | 51.65 | 40.65 | 44.65 | 49.65 | 48.65 | 47.1 |
| 2 | 0.25 | A | 35 | 12.00 | 18.00 | 35.00 | 29.00 | 30.00 | 24.8 |
| 2 | 0.25 | B | 35 | 48.65 | 39.65 | 30.65 | 35.65 | 38.65 | 38.7 |
| 3 | 0.50 | A | 25 | 49.00 | 46.00 | 46.00 | 50.00 | 44.00 | 47.0 |
| 3 | 0.50 | B | 25 | 40.30 | 47.30 | 46.30 | 44.30 | 37.30 | 43.1 |
| 3 | 0.50 | A | 35 | 25.00 | 28.00 | 25.00 | 13.00 | 16.00 | 21.4 |
| 3 | 0.50 | B | 35 | 29.30 | 43.30 | 36.30 | 39.30 | 29.30 | 35.5 |
| 4 | 0.75 | A | 25 | 18.00 | 30.00 | 35.00 | 31.00 | 22.00 | 27.2 |
| 4 | 0.75 | B | 25 | 43.95 | 42.95 | 45.95 | 23.95 | 40.95 | 39.6 |
| 4 | 0.75 | A | 35 | −10.00 | 0.00 | 13.00 | 3.00 | 8.00 | 2.8 |
| 4 | 0.75 | B | 35 | 40.95 | 32.95 | 26.95 | 2.95 | 17.95 | 24.4 |
| 5 | 1.00 | A | 25 | 30.00 | 20.00 | 21.00 | 34.00 | 18.00 | 24.6 |
| 5 | 1.00 | B | 25 | 41.60 | 42.60 | 37.60 | 44.60 | 42.60 | 41.8 |
| 5 | 1.00 | A | 35 | 7.00 | −5.00 | −5.00 | 17.00 | 2.00 | 3.2 |
| 5 | 1.00 | B | 35 | 38.60 | 44.60 | 30.60 | 27.60 | 34.60 | 35.2 |
| 6 | 0.00 | A | 25 | 36.00 | 29.00 | 35.00 | 33.00 | 45.00 | 35.6 |
| 6 | 0.00 | Aa | 25 | 21.00 | 33.00 | 9.00 | 19.00 | 15.00 | 19.4 |
| 6 | 0.00 | A | 35 | 15.00 | 7.00 | 35.00 | 28.00 | 23.00 | 21.6 |
| 6 | 0.00 | Aa | 35 | 0.00 | 15.00 | −8.00 | −5.00 | 0.00 | 0.4 |

What is claimed is:

1. A camisole garment for wearing about the body comprising a body covering assembly having an upper body opening and a lower body opening, wherein each opening having an edge about its perimeter, the body covering assembly comprising:

a relatively elastic region between the upper edge and the lower edge;

a relatively inelastic lower edge region between the relatively elastic region and the lower edge wherein the lower edge region is relatively inelastic compared to the relatively elastic region, and the lower edge region further being from about 0.25 to about 4.0 inches in width;

a relatively inelastic upper edge region between the relatively elastic region and the upper edge wherein the upper edge region is relatively inelastic compared to the relatively elastic region, and the upper edge region further being from about 0.25 to about 4.0 inches in width;

at least two opposing openings in the relatively elastic region; and, two opposing end portions of the body covering assembly between the upper edge and the lower edge engaged to form a body seam.

2. The camisole garment of claim 1, further comprising a neckline edge fold created by folding over the upper edge, the relatively inelastic upper edge region and a portion of the relatively elastic region above the opposing openings.

3. The camisole garment of claim 1, comprising an outer cover and a bodyside liner, both of which cover a series of body elastics which circumferentially surround the body to form the relatively elastic region.

4. The camisole garment according to claim 1, wherein the two opposing end portions are refastenably engaged to form a refastenable body seam.

5. The camisole garment according to claim 1, wherein the two opposing end portions are non-refastenably engaged to form a non-refastenable body seam.

6. The camisole garment according to claim 3, wherein the outer cover is a gatherable material.

7. The camisole garment according to claim 6, wherein the outer cover is a woven material.

8. The camisole garment according to claim 6, wherein the outer cover is a nonwoven material.

9. The camisole garment according to claim 6, wherein the outer cover is a polymeric film material.

10. The camisole garment according to claim 6, wherein the outer cover is a fibrous material.

11. The camisole garment according to claim 3, wherein the outer cover is an elastic material.

12. The camisole garment according to claim 10, wherein the outer cover comprises acrylic polymer, polyester, polyamide, glass, polyethylene, polypropylene, rayon, cotton, silk, wool, pulp, paper, or a blend or combination of two or more of the foregoing.

13. The camisole garment according to claim 9, wherein the outer cover comprises acrylic polymer, polyester, polyamide, polyethylene, polypropylene, or a compatible mixture, blend or copolymer thereof.

14. The camisole garment according to claim 3, wherein the outer cover is a spunbonded polyp propylene nonwoven material, meltblown polypropylene nonwoven material and spunbonded polypropylene nonwoven material laminate.

15. The camisole garment according to claim 14, wherein the outer cover has a basis weight of from about 0.4 to about 1.0 ounces per square yard, and contains about 86% spunbonded polypropylene nonwoven material and about 14% meltblown polypropylene nonwoven material.

16. The camisole garment according to claim 3, wherein the body liner is a soft, flexible porous sheet which permits submersion in fresh water, salt water, chlorinated water or brominated water and thereafter retains its integrity.

17. The camisole garment according to claim 3, wherein the body liner comprises a nonwoven or sheet of spunbonded, meltblown or bonded-carded web composed of polypropylene, polyethylene, polyester, rayon, or cotton filaments.

18. The camisole garment according to claim 3, wherein the body elastics are elastic threads, yarn rubber, flat rubber, elastic tape, polyurethane, or foamed elastic scrim.

19. The camisole garment according to claim 3, wherein the body elastics are elongated to between about 50% to about 300%.

20. The camisole garment according to claim 3, wherein the body covering assembly is made of materials having stretch characteristics such that the body covering assembly is capable of between about 50% to about 300% elongation, and recovery, upon release of tension, of at least 80% of its elongation.

21. The camisole garment according to claim 3, wherein the body covering assembly is made of materials capable of stretching in one direction.

22. The camisole garment according to claim 3, wherein the body covering assembly is made of materials capable of stretching in two substantially perpendicular directions.

23. A camisole garment for wearing about the body comprising a body covering assembly having an upper body opening and a lower body opening, wherein each opening having an edge about its perimeter, the body covering assembly comprising:

a single layer web of fabric between the upper edge and the lower edge;

at least two opposing openings in the body covering assembly;

two opposing end portions between the upper edge and the lower edge;

a neckline edge fold created by folding the upper edge and a portion of the body covering assembly above the opposing openings; and, a non-refastenable body seam by engaging the two opposing end portions.

24. A camisole garment for wearing about the body comprising a body covering assembly having an upper body opening and a lower body opening, wherein each opening having an edge about its perimeter, the body covering assembly comprising:

a single layer web of fabric between the upper edge and the lower edge;

at least one opening in the body covering assembly adjacent to the upper edge of the fabric;

two opposing end portions between the upper edge and the lower edge;

a neckline edge fold created by folding the upper edge and a portion of the body covering assembly above the opening;

a non-refastenable body seam by engaging the two opposing end portions.

25. A camisole garment for wearing about the body comprising a body covering assembly having an upper body opening and a lower body opening, wherein each opening having an edge about its perimeter, the body covering assembly comprising:

a relatively elastic region between the upper edge and the lower edge;

a relatively inelastic lower edge region between the relatively elastic region and the lower edge wherein the lower edge region is relatively inelastic compared to the relatively elastic region, and the lower edge region further being from about 0.25 to about 4.0 inches in width;

an relatively inelastic upper edge region between the relatively elastic region and the upper edge wherein the upper edge region is relatively inelastic compared to the relatively elastic region, and the upper edge region further being from about 0.25 to about 4.0 inches in width;

at least one opening in the relatively elastic region; and, two opposing end portions of the body covering assembly between the upper edge and the lower edge engaged to form a body seam.

26. The camisole garment of claim 25, further comprising a neckline edge fold created by folding over the upper edge, the relatively inelastic upper edge region and a portion of the relatively elastic region above the opening.

27. The camisole garment of claim 25, comprising an outer cover and a bodyside liner, both of which cover a series of body elastics which circumferentially surround the body to form the relatively elastic region.

28. The camisole garment according to claim 25, wherein the two opposing end portions are refastenably engaged to form a refastenable body seam.

29. The camisole garment according to claim 25, wherein the two opposing end portions are non-refastenably engaged to form a non-refastenable body seam.

* * * * *